US007353757B2

(12) United States Patent
Eldridge

(10) Patent No.: US 7,353,757 B2
(45) Date of Patent: Apr. 8, 2008

(54) TOGGLE SLIDE-PLATE FOR RAILWAY SPIKE PULLER

(75) Inventor: Joseph L. Eldridge, Libertyville, IL (US)

(73) Assignee: Nordco Inc., Oak Creek, WI (US)

( * ) Notice: Subject to any disclaimer, the term of this patent is extended or adjusted under 35 U.S.C. 154(b) by 246 days.

(21) Appl. No.: 11/283,652

(22) Filed: Nov. 21, 2005

(65) Prior Publication Data

US 2007/0113752 A1 May 24, 2007

(51) Int. Cl.
*E01B 29/26* (2006.01)

(52) U.S. Cl. ..... 104/17.1

(58) Field of Classification Search ..... 104/2, 104/7.1, 17.1, 17.2; 254/18
See application file for complete search history.

(56) References Cited

U.S. PATENT DOCUMENTS 2,826,446 A * 3/1958 Hursh ..... 104/17.1
3,066,913 A * 12/1962 Leeson ..... 254/18
3,883,118 A * 5/1975 Miller ..... 254/18
4,538,793 A 9/1985 Dieringer et al.
5,253,844 A * 10/1993 Cotic et al. ..... 254/18

* cited by examiner

*Primary Examiner*—Lars A Olson
(74) *Attorney, Agent, or Firm*—Greer, Burns & Crain, Ltd.

(57) ABSTRACT

A toggle slide-plate for use in a spike-pulling machine, where the toggle slide-plate is configured for aiding in supporting the movement of a pair of pivotable arms each having a spike-pulling claw configured for removing a spike from a railroad tie, the pair of pivotable arms being configured for moving in a direction perpendicular to a longitudinal axis of a rail and the toggle plate being configured for preventing twisting of the pair of pivotable arms, the toggle slide-plate including: a mid-plate having a first end and a second end, a first endplate connected to the first end, a second endplate connected to the second end, and a wear pad secured to each of the first endplate and the second endplate.

19 Claims, 2 Drawing Sheets

TOGGLE SLIDE-PLATE FOR RAILWAY SPIKE PULLER

BACKGROUND OF THE INVENTION

The present invention generally relates to machines for use in the maintenance of a railroad track, and more particularly to a toggle slide-plate for use in a railroad spike-pulling machine.

Maintenance of railroad tracks and the periodic replacement of wooden railroad ties or worn rails or rail segments require the removal of spikes from the ties and corresponding tie plates to separate the rails from the ties and position the new ties. In the present application, "spikes" will be understood to mean rail fasteners including standard "cut" spikes, hairpin spikes, screw spikes, and other equivalent rail fasteners. Railroad spike-pulling machines, of the type disclosed in commonly assigned U.S. Pat. No. 4,538,793, incorporated by reference, accomplish the removal of these spikes with a gripping or clamping assembly generally including a pair of reciprocating jaws, where each jaw is located on a corresponding side of the rail. Each jaw also has a claw member at a distal jaw end that is operable for gripping the head of the spike. Once the claw member has gripped the spike, a mechanical linkage lifts the jaws upward so that the spike is pulled from the tie and the tie plate. The mechanical linkage for lifting the clamping assembly generally includes fluid power cylinders, as known in the art.

One problem that arises during operation of these assemblies is that as the machine travels along the track, the jaws are subjected to a perpendicular force. This force can cause the jaws to twist, misaligning them and preventing the claw members from properly gripping the tie spikes.

To address this potential problem, supporting connecting links were developed to maintain the alignment between the jaws and prevent them from twisting. A lower end of each pair of connecting links is attached by brackets to the pivotable intermediate section of the jaws. A hydraulic cylinder is configured to maintain a connection between the lower ends of the connecting links, and helps to prevent the jaws from twisting. An upper end of each of the connecting links is connected to a pair of spaced apart guide slots which define the travel limits of the links during movement of the jaws.

The opposite ends of the guide slots are generally supported by a plate assembly. Current plate assemblies generally include a pair of endplates supported for vertical movement by a mid-plate. The opposite ends of the mid-plate are slidably housed in channels in a supporting frame member. The mid-plate slides up and down the channels as the jaws move away and towards the spike, respectively. One problem that arises with these plate assemblies is that the ends of the mid-plate become worn down through sliding on the channels, requiring the plate to be replaced. To replace the plate assembly, the connecting links must be unscrewed from the endplates, and then the endplates must be removed from the mid-plate, so the mid-plate can be removed from the machine.

However, this process can be very time consuming because the plate assembly is virtually inaccessible after assembly of the machine, thus reducing operating efficiency. Furthermore, replacement of the mid-plate requires the use of special tools that can access the plate assembly. Also, the entire mid-plate needs to be replaced in current plate assemblies, even though only the ends of the mid-plate have been worn down. Therefore, replacement of the entire mid-plate is not cost-effective. In addition, during operation of the tool, the plurality of welds that secure the endplates to the mid-plate can become loosened, reducing the effectiveness of the plate assembly by permitting twisting of the jaws.

Therefore, there exists a need for a plate assembly that can be easily replaced after the ends of the mid-plate become worn down. There also exists a need for a plate assembly where the ends of the mid-plate can be replaced without the use of special tools and without the need to disassemble the spike-pulling machine. Also, there exists a need for a method of replacing the worn down ends of the mid-plate without the need to replace the entire mid-plate. Finally, there exists a need for a plate assembly that is accessible after assembly of the machine, so that adjustments can be easily made.

BRIEF SUMMARY OF THE INVENTION

The above-listed needs are met or exceeded by the present toggle slide-plate, which allows the user to easily replace the ends of the mid-plate after they have become worn down from repeated operation of the machine. Also, the present slide-plate provides a method for replacing only the worn down portion of the assembly, increasing cost-effectiveness and eliminating the need to replace the entire mid-plate. In addition, replacement of the ends of the mid-plate does not require the use of special tools. The present plate is also easily accessible after assembly of the spike-pulling machine, so that adjustments can easily be made when necessary.

More specifically, the present slide-plate provides a mid-plate having a first end and a second end, a first endplate connected to the first end, a second endplate connected to the second end, and a wear pad secured to each of the first endplate and the second endplate.

In another embodiment, a toggle slide-plate is provided for use in a spike-pulling machine and configured for facilitating the movement of a pair of pivotable arms each having a spike-pulling claw configured for removing a spike from a railroad tie, the pair of pivotable arms being configured for moving in a direction perpendicular to a longitudinal axis of a rail and the toggle slide-plate being configured for preventing twisting of the pair of pivotable arms. The toggle slide-plate includes a mid-plate having a first end and a second end, a first endplate connected to the first end and a second endplate connected to the second end. A groove portion is located in a middle of both the first endplate and the second endplate, each groove portion further including at least one hole. A wear pad is configured to be removably secured to each groove portion, each wear pad further including at least one throughbore corresponding with the at least one groove portion hole, and a pair of fasteners are configured for insertion into each pair of groove portion holes and wear pad throughbores. Each pair of fasteners is configured for securing the first endplate or the second endplate to each wear pad.

DETAILED DESCRIPTION OF THE INVENTION

Figure 1:
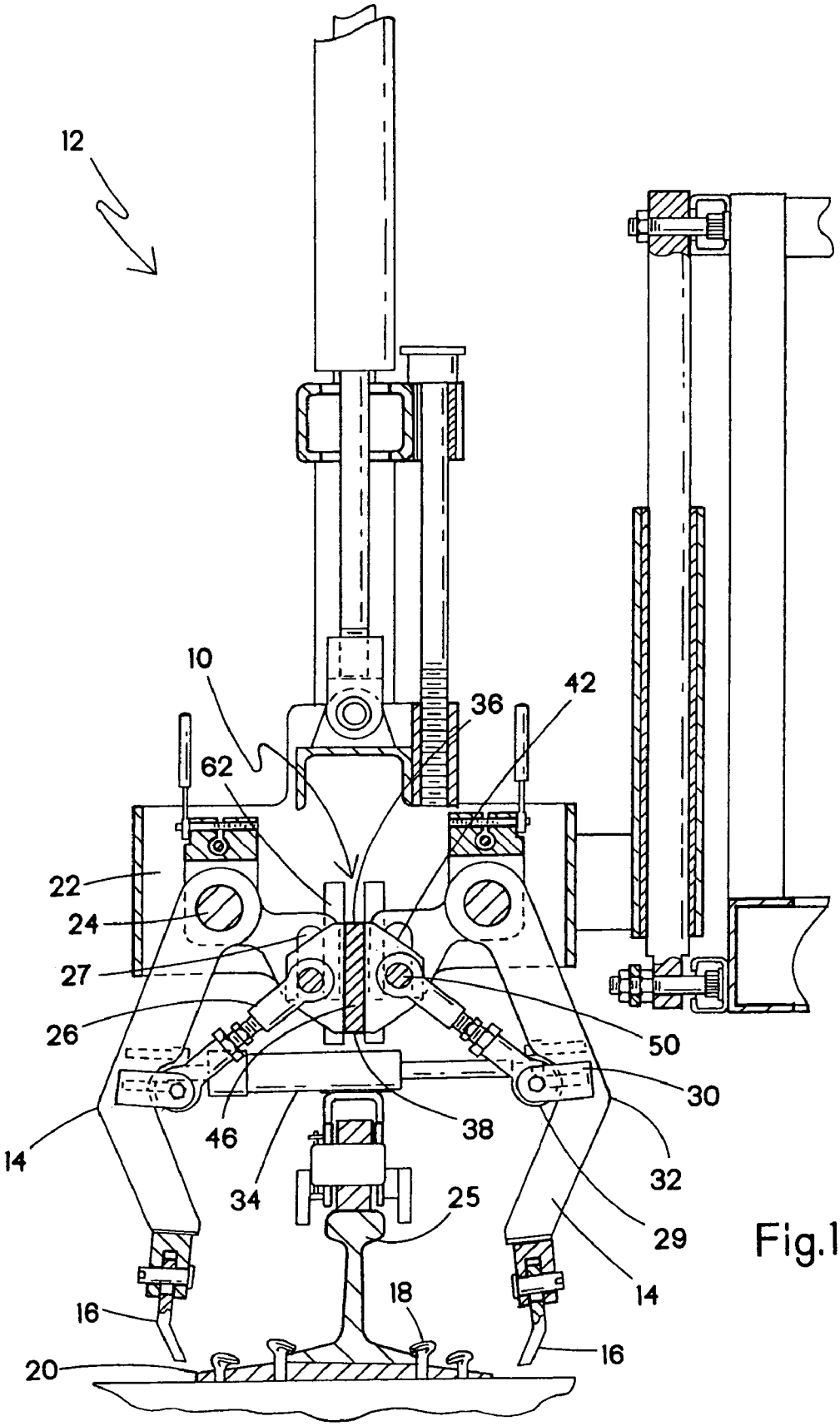
FIG. 1 is a front elevational view of a spike-pulling machine incorporating the present toggle slide-plate.

Referring to FIG. 1, the present invention provides a toggle slide-plate generally designated 10 and configured for use in a spike-pulling machine 12. Details of the machine 12 are provided in U.S. Pat. No. 4,538,793, incorporated by reference. The toggle slide-plate 10 is configured to aid in supporting the movement of a pair of pivotable arms 14. A lower end of each of the pivotable arms 14 generally includes a spike-pulling claw 16 configured to remove a spike 18 from a railroad tie 20. Upper ends of the pivotable arms 14 are pivotally joined to a support block 22 by pivot rods or shafts 24. The arms 14 are supported by the shafts 24 for pivotable movement about spaced axes parallel to a longitudinal axis of a rail 25. The arms 14 are also supported such that the claws 16 move generally arcuately toward and away from each other and from the rail 25.

A mechanism is provided for supporting the pivotable arms 14 during movement in directions perpendicular to the longitudinal axis of the rail 25, and for preventing twisting of the arms. This mechanism generally includes a pair of connecting links 26, the upper ends 27 of which are pivotally connected to the slide-plate 10. Lower ends 29 of the connecting links 26 are each pivotally connected by a corresponding bracket 30 to a midpoint 32 of the corresponding pivotable arm 14. It is contemplated that the connecting links 26 are provided for supporting the pivotable arms 14 against forces on the pivotable arms in the direction of the longitudinal axis of the rail 25. While shown as adjustable, the links 26 may alternately be fixed, depending on the application.

The present toggle slide-plate 10 is configured for preventing twisting of the pair of pivotable arms 14 during operation of the machine 12. For controlling operational movement of the arms 14 in a direction perpendicular to the longitudinal axis of the rail 25, a fluid power cylinder such as a hydraulic cylinder 34 is provided to connect the arms 14 at their respective midpoints 32.

Figure 2:
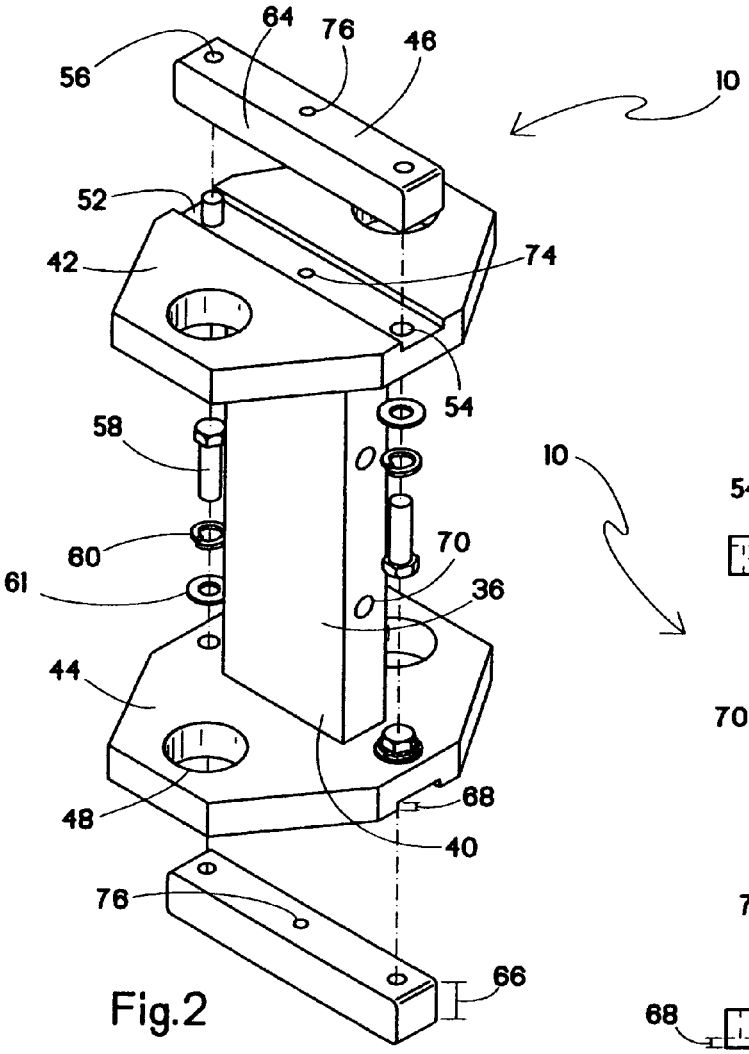
FIG. 2 is an exploded perspective view of the present toggle slide-plate.
Figure 3:
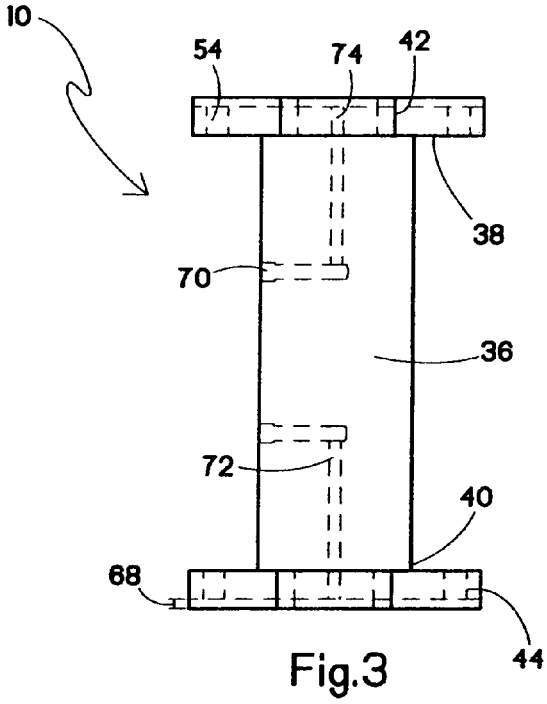
FIG. 3 is a side elevational view of the present toggle slide-plate.

Referring to FIGS. 2 and 3, the toggle slide-plate 10 includes a mid-plate 36 having a first end 38 and a second end 40, a first endplate 42 connected to the first end, a second endplate 44 connected to the second end, and a wear pad 46 removably secured to each of the first endplate and the second endplate. It is contemplated that the first endplate 42 is connected to the mid-plate 36 at the center of the first endplate, and that the second endplate 44 is connected to the mid-plate at the center of the second endplate. It is further contemplated that this configuration will provide balanced support to each of the pivotable arms 14 during operation of the machine 12. However, it is appreciated that different points of connection to the mid-plate 36 are possible, as are known in the art.

In the preferred embodiment, the mid-plate 36 and the first and second endplates 42 and 44 are secured together, as by welding, to form a unitary piece, preferably manufactured out of ASTM A36 steel, or other materials having equivalent durability, strength and cost characteristics, as are known in the art. Unlike current plate assemblies which can become loosened during operation of the machine 12, it is contemplated that by providing the present toggle slide plate 10 as a unit, it will not be as greatly affected by the torque generated during operation. The first and second endplates 42 and 44 preferably have a thickness of approximately 0.75 inch, while the mid-plate 36 preferably has a thickness of approximately 1 inch. While other thicknesses are envisioned, it is contemplated that the preferred first endplate 42 and second endplate 44 thicknesses will provide a greater stability for the slide-plate 10 when compared to current plate assemblies, which generally have endplate thicknesses of approximately 0.5 inch. In addition, the increased thicknesses of the first endplate 42 and second endplate 44 will provide increased support to the pivotable arms 14.

Figure 4:
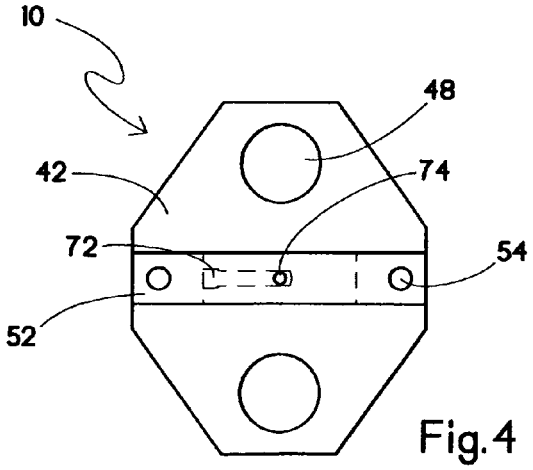
FIG. 4 is a front view of an endplate of the present toggle slide-plate.

Referring to FIGS. 1, 2 and 4, it is contemplated that both the first endplate 42 and the second endplate 44 are octagonal in shape when viewed in plan. However, it is appreciated that other shapes are possible, depending on the needs of the user.

Referring still to FIGS. 1, 2 and 4, both the first endplate 42 and the second endplate 44 include a pair of openings 48 configured for receiving a shaft 50. It is contemplated that the pair of openings 48 in the first endplate 42 are configured to be axially aligned with the pair of openings in the second endplate 44. It is contemplated that this arrangement will maintain a perpendicular relationship between the slide-plate 10 and the longitudinal axis of the rail 25, and will aid in preventing twisting of the pivotable arms 14.

As seen in FIGS. 2 and 4, both the first endplate 42 and the second endplate 44 further include a groove portion 52 preferably aligned with the mid-plate 36. It is contemplated that the groove portion 52 has a depth of approximately ½ inch. It is further contemplated that each wear pad 46 is constructed and arranged to be removably secured within a corresponding groove portion 52. Each groove portion 52 further includes at least one and preferably a pair of holes 54. Each wear pad 46 also contains a corresponding number of throughbores 56, which are each configured to align with the at least one groove portion hole 54.

Referring to FIG. 2, both the first endplate 42 and the second endplate 44 further include at least one and preferably a pair of preferably threaded fasteners 58 configured to be inserted through each groove portion hole 54 and each wear pad through bore 56. The fasteners are configured to secure each wear pad 46 to either the first endplate 42 or the second endplate 44. In addition, to further secure each wear pad 46 either to the first endplate 42 or the second endplate 44, at least one lock washer 60, and one or more flat washers 61 are optionally provided and are preferably engaged upon each of the fasteners 58. It is also contemplated that each fastener 58 has a hexagonal shaped head, as seen in FIG. 2. It is further contemplated that each of the hexagonal shaped fasteners 58 is easily accessible after assembly of the machine 12, allowing the fasteners to be easily loosened or retightened, depending on the needs of the user. While a threaded fastener 58 is described here, other suitable releasable fasteners are contemplated in this application.

Referring again to FIG. 1, during operation of the machine 12, each wear pad 46 is configured to slide in a track 62 defined by a pair of spaced parallel guides located on the support block 22. After continued operation of the machine 12, each of the wear pads 46 will eventually become worn down and need replacement. It is preferred that the wear pad 46 is manufactured out of bronze, having a height of approximately one inch, although it is appreciated that other materials and dimensions are available, as are known in the art. It is contemplated that although the bronze wear pad 46 may wear out faster, it is safer to use and also cheaper to replace than other materials. It is further contemplated that by manufacturing the wear pad 46 out of bronze and the remainder of the slide-plate 10 out of steel, the life of the slide-plate is increased, because when the wear pad becomes worn down, it can be separately replaced without the need to replace the entire slide-plate.

Referring to FIG. 2, it is contemplated that the wear pad 46 generally includes an elongate, bar-like body 64 having four planar, generally rectangular sides and two generally square-shaped ends. It is further contemplated that the body 64 has a height 66 greater than a depth 68 of the groove portion 52, forming a projecting portion that is configured for sliding in the track 62 of the machine 12. It is contemplated that the projecting portion makes up approximately one half of the wear pad 46, with the remaining approximate half configured for insertion into the groove portion 52. In the preferred embodiment, the wear pad 46 height 66 is approximately one inch, and the groove portion 52 depth 68 is approximately ½ inch. However, it is contemplated that other proportional arrangements are possible, depending on the needs of the application.

Referring to FIG. 3, the mid-plate 36 of the slide-plate 10 further includes at least one and preferably a pair of gallery openings 70. Each gallery opening 70 is preferably in communication with a corresponding lubricant gallery 72, which extends through the mid-plate 36 and out to a corresponding lubricant opening 74 in the groove portion 52. It is contemplated that grease, oil or another lubricant with similar characteristics is inserted into each gallery opening 70, where it flows through the corresponding lubricant gallery 72 and lubricant opening 74, and exits out into the corresponding groove portion 52. The wear pad 46 further includes at least one lubricant passageway 76 (see FIG. 2) configured for alignment with the lubricant opening 74. Thus, lubricant passing through the lubricant opening 74 will also pass through the lubricant passageway 76, lubricating the body 64 of the wear pad 46. The present lubrication arrangement reduces friction between both the wear pad 46 and the groove portion 52 and the wear pad and the track 62, increasing the life of the wear pad.

A method for replacing each old wear pad 46 of the slide-plate can be practiced using the present slide-plate assembly, best seen in FIG. 2. The method includes loosening the pair of fasteners 58 configured to secure the old wear pad 46 to either the first or second endplate 42 or 44, removing the old wear pad from the groove portion 52 of either the first or second endplate, inserting a new wear pad (not shown) into the groove portion of either the first or second endplate, and tightening the pair of fasteners, where the fasteners secure the new wear pad to either the first or second endplate. However, it is also contemplated that other methods of insertion can be provided, depending on the needs of the user.

The above-identified method for the present slide-plate assembly is advantageous over current plate assemblies because only the wear pad 46 needs to be replaced, not the entire mid-plate. In addition, it is contemplated that in the present method, the fasteners 58 are easily accessible after assembly of the spike-pulling machine 12, so that replacement of the wear pads 46 can be easily accomplished in a time-effective manner. The present method is more cost-effective than current plate assemblies because only the wear pad 46 needs to be replaced, compared to the entire mid-plate in current plate assemblies.

While a particular embodiment of the present toggle slide-plate has been described herein, it will be appreciated by those skilled in the art that changes and modifications may be made thereto without departing from the invention in its broader aspects and as set forth in the following claims.

The invention claimed is:

1. A toggle slide-plate for use in a spike-pulling machine, wherein said toggle slide-plate is configured for supporting the movement of a pair of pivotable arms each having a spike-pulling claw configured for removing a spike from a railroad tie, the pair of pivotable arms being configured for moving in a direction perpendicular to a longitudinal axis of a rail and said toggle slide-plate being configured for preventing twisting of the pair of pivotable arms, said toggle slide-plate comprising:

a mid-plate having a first end and a second end;

a first endplate connected to said first end;

a second endplate connected to said second end; and a wear pad secured to each of said first endplate and said second endplate.

2. The slide-plate of claim 1 wherein said mid-plate further includes a gallery opening and a lubricant gallery configured for receiving and providing a passageway for a lubricant.

3. The slide-plate of claim 1 wherein said first endplate is connected to said mid-plate at a center of said first endplate, and wherein said second endplate is connected to said mid-plate at a center of said second endplate.

4. The slide-plate of claim 1 wherein both said first endplate and said second endplate are octagonal in shape when viewed in plan.

5. The slide-plate of claim 1 wherein both said first endplate and said second endplate include a pair of openings, wherein each of said openings is configured for receiving a shaft.

6. The slide-plate of claim 5 wherein said pair of openings on said first endplate are configured for alignment with said pair of openings on said second endplate.

7. The slide-plate of claim 2 wherein both said first endplate and said second endplate further include a groove portion configured for alignment with said mid-plate.

8. The slide-plate of claim 7 wherein each said wear pad is configured to be removably secured to each of said first and second endplates.

9. The slide-plate of claim 7 wherein each said groove portion includes at least one hole and a lubricant opening configured for alignment with said lubricant gallery.

10. The slide-plate of claim 9 wherein each said wear pad includes at least one throughbore that is configured for alignment with each said groove portion hole and a lubricant passageway configured for alignment with said lubricant opening.

11. The slide-plate of claim 10 wherein both said first endplate and said second endplate further include at least one fastener configured for insertion through each said groove portion hole and each said wear pad throughbore, wherein said fastener is configured for securing each said wear pad to either said first endplate or said second endplate.

12. The slide-plate of claim 1 wherein each said wear pad is configured for sliding in a track located on said spike-pulling machine.

13. A toggle slide-plate for use in a spike-pulling machine and configured for facilitating the movement of a pair of pivotable arms each having a spike-pulling claw configured for removing a spike from a railroad tie, the pair of pivotable arms being configured for moving in a direction perpendicular to a longitudinal axis of a rail and said toggle slide-plate being configured for preventing twisting of the pair of pivotable arms, said toggle slide-plate comprising:

a mid-plate having a first end and a second end;

a first endplate connected to said first end;

a second endplate connected to said second end;

a groove portion located in a middle of both said first endplate and said second endplate, each said groove portion further including at least one hole;

a wear pad configured to be removably secured to each said groove portion, each said wear pad further including at least one throughbore corresponding with said at least one groove portion hole; and a pair of fasteners configured for insertion into each pair of groove portion holes and wear pad throughbores, wherein each pair of said fasteners is configured for securing said first endplate or said second endplate to each said wear pad.

14. The slide-plate of claim 13 wherein both said first endplate and said second endplate include a pair of openings wherein each of said openings is configured for receiving a shaft.

15. The slide-plate of claim 14 wherein said openings in said first endplate are configured for alignment with said openings in said second endplate.

16. A wear pad for use in a toggle slide-plate in a railway spike pulling machine, the slide-plate configured for facilitating the movement of a pair of pivotable arms each having a spike-pulling claw configured for removing a spike from a railroad tie; the pair of pivotable arms being configured for moving in a direction perpendicular to a longitudinal axis of a rail, the toggle slide-plate being configured for preventing twisting of the pair of pivotable arms; and wherein the toggle slide-plate includes a mid-plate having a first end and a second end, the mid-plate including an lubricant gallery opening and a lubricant gallery configured for allowing the passage of a lubricant, a first endplate connected to the first end, a second endplate connected to the second end, and a groove portion located in a middle of both the first and second endplates, each groove portion further including at least one hole and a lubricant opening in alignment with the lubricant gallery, the opening configured for releasing the lubricant into the groove portion, said wear pad comprising:

a generally elongate body configured for insertion into the groove portion, said body having a height greater than a depth of the groove portion for sliding in a track defined by the machine;

at least one throughbore corresponding with the at least one groove portion hole, wherein said wear pad is configured to be secured to each groove portion; and at least one lubricant passageway configured for receiving and dispersing the lubricant passed through the lubricant opening, the lubricant being configured for reducing friction between said wear pad and said track.

17. The wear pad of claim 16 wherein said wear pad body includes four planar, generally rectangular sides and two generally square-shaped ends.

18. The wear pad of claim 16 wherein at least one fastener is configured for insertion into each pair of wear pad throughbores and the groove portion holes, each said fastener being configured for securing said wear pad to the first endplate or the second endplate.

19. The wear pad of claim 16 wherein said wear pad is configured to be removably secured to said groove portion.

* * * * *